United States Patent [19]

Smith

[11] 4,285,684

[45] Aug. 25, 1981

[54] HEAD FOR SLITTER-CORRUGATOR

[75] Inventor: Willis D. Smith, Camas, Wash.

[73] Assignee: Tidland Corporation, Camas, Wash.

[21] Appl. No.: 927,569

[22] Filed: Jul. 24, 1978

[51] Int. Cl.[3] ..... B26D 7/26

[52] U.S. Cl. ..... 493/355; 83/665; 493/336; 493/474

[58] Field of Search ..... 93/58 R, 58.1, 58.2 R; 83/665; 93/62; 24/263 SB; 279/28; 335/285; 403/326–328; 493/355, 366, 371, 474

[56] References Cited

U.S. PATENT DOCUMENTS

| | | | |
|---|---|---|---|
| 143,907 | 10/1873 | Hyde | 24/263 SB |
| 1,033,040 | 7/1912 | Staude | 93/62 X |
| 1,046,078 | 12/1912 | Klotz | 93/58.2 R |
| 1,057,097 | 3/1913 | Smith | 279/28 |
| 1,084,785 | 1/1914 | Burpee | 93/58 R |
| 1,091,204 | 3/1914 | Ferres | 493/365 X |
| 1,974,124 | 9/1934 | Riebel et al. | 403/328 X |
| 4,006,671 | 2/1977 | Ochs | 493/474 |

FOREIGN PATENT DOCUMENTS

| | | | |
|---|---|---|---|
| 1451997 | 8/1966 | France | 335/285 |

*Primary Examiner*—Robert D. Baldwin

*Attorney, Agent, or Firm*—Klarquist, Sparkman, Campbell, Leigh, Whinston & Dellett

[57] ABSTRACT

A ring-like head for a slitter-corrugator having an interiorly located spring-pressed pad for pressure contact with an air shaft to preclude inadvertent side shifting of the head at set-up time. The pad has a chamfered peripheral edge for ready movement over edge portions on the shaft.

7 Claims, 2 Drawing Figures

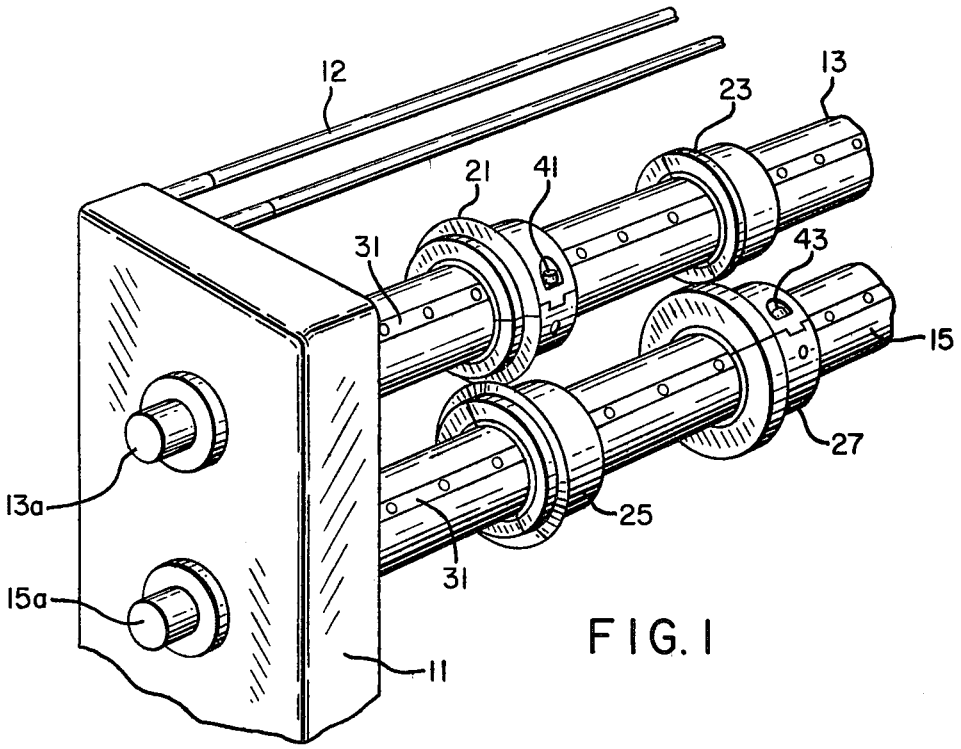
FIG. 1
FIG. 2
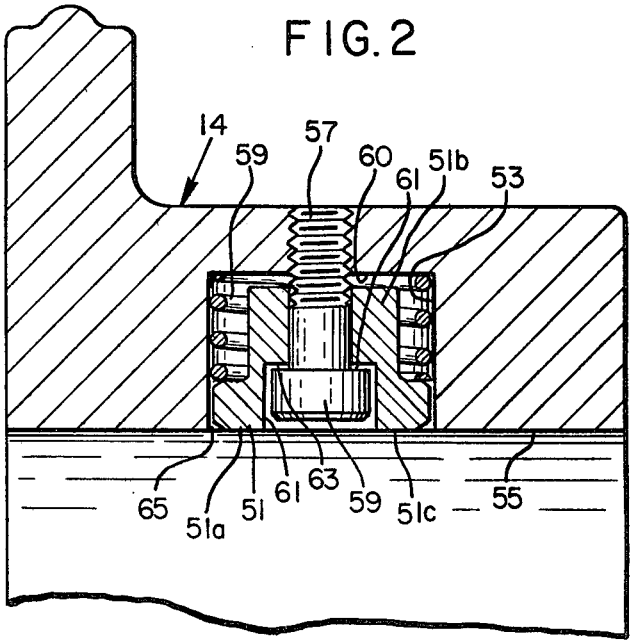

HEAD FOR SLITTER-CORRUGATOR

BACKGROUND OF THE INVENTION

At present, it is common to utilize air shafts in slitter-corrugators. A shaft is typically equipped with a clamping strip or leaf which can be projected outwardly into clamping engagement with heads on the shaft to hold the heads in the positions to which they have been adjusted for accomplishing various slitting, slotting and scoring operations on sheet material. Accurate positioning is essential in order to produce a proper end product.

When it is desired to readjust or reset the heads, the air pressure on the shafts is decreased to release the clamping pressure on the heads and to enable them to be slid along the shafts to the new positions of adjustment. Thus, typically, an operator will start at one end of a pair of shafts, setting the heads in the proper positions and proceed along the shafts toward the opposite end.

There is nothing at the set-up time to hold the heads in position except the frictional contact with the shafts on which they are mounted.

Frequently, the idle machine is closely adjacent other machines and is subject to the vibrations and shocks created by the operation of such other machines. The vibrating forces and shocks can cause the heads to shift axially along the shafts somewhat. This means that the operator has to go back again, making a second, or perhaps a third check to be sure the heads are all in proper positions before applying the clamping air pressure to the shafts. This is time-consuming and thus expensive.

SUMMARY OF THE INVENTION

The present invention relates to an improved head construction and particularly one equipped with an interiorly located spring biased pad which is in pressure contact with the shaft at all times, including set-up time. The pressure applied by the spring-biased pad is sufficient to hold the heads in various positions of adjustment but not so severe as to pevent the heads from being shifted to new positions. In addition, elements are provided for limiting the amount of movement of the spring pressed pads so that they are held in position at the time the heads are removed from the shafts. In addition, the pads have chamfered edges to provide ramp-like portions enabling the edges to ride over sharp axially located edge portions on the shafts to avoid hang up when the heads are circumferentially adjusted, such as for instance, when accurately located heads designed to form spaced slits in a sheet.

A main object of the present invention is to provide an improved head for a slitter-corrugator and particularly to provide one with means for preventing it from being inadvertently shifted from a set position to facilitate accurate and rapid set-up of the slitter-corrugator.

A further object of the invention is to provide such a head equipped with a spring biased pad retained in position against accidental dislodgement but movable a limited amount to establish a desired contact pressure between the pad and a shaft on which the pad is mounted.

A further object of the invention is to provide an improved slitter-corrugator having heads formed with spring biased pads which are designed to ride over axially extending edge portions of the shafts.

The subject matter which we regard as our invention is particularly pointed out and distinctly claimed in the concluding portion of this specification. The invention, however, both as to organization and method of operation, together with further advantages and objects thereof, may be best understood by reference to the following description, taken in connection with the following drawings, wherein like reference characters refer to like elements.

In the drawings:

FIG. 1 is a perspective view of a part of a slitter-corrugator having two drive shafts equipped with heads of my invention; and FIG. 2 is a cross sectional view through a head showing the inventive feature of the head.

FIG. 1 shows a portion of a sheet slitter-corrugator having a frame which includes a pair of upstanding standards, one, 11, being shown in FIG. 1. The frames frequently are connected at their upper ends by stabilizing rods 12.

The corrugator is equipped with a pair of air shafts 13 and 15 of common form which are journaled at their end in the standards 11, as shown at 13*a* and 15*a* in FIG. 1 for the standard 11 there shown. The shafts may be of the form shown in U.S. Pat. No. 4,006,671, to Gordon M. Ochs, issued Feb. 8, 1977.

Each shaft is equipped with plural ring-like heads, two, numbered 21 and 23 being shown for shaft 13, and two, 25 and 27 being shown for shaft 15. The heads are paired up, 21 and 25, and 23 and 27, and cooperate to perform desired slitting, slotting, scoring, etc., operations on sheet material fed between the mandrels by a feed mechanism, not shown.

The heads are selected as to type for the particular operations to be performed, and are precisely located along the shaft to desired positions in accordance with the dimensional requirements of the end product to be formed from the sheet material. A typical use of a slitter-corrugator is to score and slit corrugated sheets to be made into corrugated containers.

The air shafts are hollow and each has an air bag (not shown) in its interior underlying a movable leaf 31, which, when in its inoperative position, is slightly recessed inwardly from the exterior circumferential surface of the shaft. When the air bag is supplied with air under pressure, the leaf is projected radially outwardly into engagement with the inner surfaces of the heads to clamp them immovably in desired positions and prevent their shifting along the shaft during operation of the machine.

The heads can be of various constructions. Typically they are split so as to comprise two halves bolted together by a pair of bolts, one, 41, being shown in FIG. 1 for head 21, and another, 43, being shown for a head 27. This enables the heads to be initially applied to the shafts without having to remove (or partially remove) the shafts from the machine.

Also, quite frequently, the operating element, be it a slitter, or scorer, etc., is also split. Sometimes it comprises an element separate from the hub itself, but is bolted to the hub. It is also not uncommon to form the operating element integral with the hub as shown in FIG. 2. It is immaterial to the present invention whether the operating element is integral or separate.

The above description is of a more or less standard slitter-corrugator machine. My invention comprises the provision of a means for resisting axial movement of the hubs of the heads at "set-up" time. That is to say, when it is desired to adjust the positions of the heads initially for the particular spacing demanded by the product being produced, air bags within the shafts are relaxed and the leaves 31 depress, loosening their grip on the heads. Not infrequently at head set-up time, associated equipment is in operation transmitting vibratory movement to the idle corrugator or slitter. Or, the operator in setting up the heads, and after setting up the first pair of heads, can accidentally strike the set up pair, moving the same from their set-up positions, which is obviously undesirable. My movement-resisting means will prevent inadvertent movement of the heads unless they are positively moved therefrom.

Referring to FIG. 2, my movement-resisting means includes a friction pad or button 51 disposed in a recess 53 formed in the interior cylindrical surface 55 of head H shown in FIG. 2. A bolt 57 has its head 59 recessed within a pocket 61 formed in the center of the pad 51 and has its shank provided with threads threading into the body of the head H of FIG. 2. The pad is of circular cross section and has a head portion 51*a* and a shank portion 51*b* of smaller diameter than the head portion to leave an annular chamber occupied by a compression spring 59, which bears at its one end on the bottom wall 60 of the recess 53 and at its opposite end against the flange-like head 51*a* of the button 51.

As the parts are shown in FIG. 2, the inner surface 51*c* of the head is shown as being substantially flush with the inner cylindrical surface 55 of the head. With the parts so disposed, this will leave a space between the head 51*a* and the bottom wall 63 of the pocket 61 of the pad. This space determines the extent to which the pad can be projected out of the pad recess, which extent is slightly beyond the inner cylindrical surface 55.

Note that the pad has its peripheral edges at 65 chamfered. This is to enable the head to be adjusted circumferentially on its shaft without hang up of the pad on the edges of the slot in which the leaf 31 fits.

What is claimed is:

1. A head for a sheet slitter-corrugator comprising a ring member slidably fitting on a supporting shaft, said ring member having an inner cylindrical surface to be engaged by a clamping means on the shaft for fixedly holding said ring member in a desired position of adjustment, and movement-resisting biasing means on said ring member for applying a biasing force between the ring member and supporting shaft when said clamping means is inoperative, to thereby releasably retain said ring member against axial movement whereby to prevent inadvertent movement that might otherwise occur at said head set-up time but permitting axial movement in either direction of said ring along the shaft to facilitate setting up of said ring.

2. A head as recited in claim 1 in which said movement-resisting biasing means includes a shaft contacting element exposed at said inner cylindrical surface and breaking the curved plane of such surface, and spring means for applying a radially inwardly directed force on said shaft contacting element.

3. A head as recited in claim 2 in which said shaft contacting element is in the form of a friction pad, and means for limiting inward movement of the pad to a point wherein it projects just beyond the said inner cylindrical surface of said ring member.

4. A head as recited in claim 3 in which said pad has a radial axis and an inwardly located head for contacting the shaft on which said head is mounted, the portion of said pad projecting beyond the inner cylindrical surface of said ring member being chamfered at its edges to facilitate movement past edge portions when the head is circumferentially adjusted.

5. A head as recited in claim 4 in which said ring member is formed on its interior surface with a recess, said pad being disposed within said recess, said pad having a shank portion spaced away from the walls of said pocket to provide an annular chamber, said spring means comprising a single compression spring disposed within said annular chamber, said movement-limiting means comprising a bolt having a head recessed within said pad and a shank passing through said pad and threadedly received by said ring member.

6. A slitter-corrugator shaft assembly having at least one shaft, at least one head on said shaft, said head comprising a ring member having an inner cylindrical surface slidably engaging said shaft, clamping means on the shaft for positively releasably locking said ring member in a desired position of adjustment immovably on said shaft, and non-locking movement-resisting biasing means on said ring member for applying a movement-resisting force between the ring member and supporting shaft of a magnitude insufficient to lock said head on said shaft but sufficient, when said clamping means is inoperative, to urge said ring member to remain stationary against light axial displacement forces whereby to prevent inadvertent movement of said head that might otherwise occur at head set-up time but permitting adjusting movement under hand pressure in either direction along said shaft.

7. A slitter-corrugator having at least one shaft with exposed exterior longitudinal edges, at least one head on said shaft, said head comprising a ring member having an inner cylindrical surface to be engaged by a clamping means on the shaft for holding said ring member in a desired position of adjustment, and movement-resisting means on said ring member for applying a movement-resisting force between the ring member and supporting shaft when said clamping means is inoperative, to thereby releasably retain said ring member against axial movement whereby to prevent inadvertent movement that might otherwise occur at head set-up time, said movement-resisting means including a shaft contacting element, and spring means for applying a radially inwardly directed force on said shaft contacting element, said shaft contacting element is in the form of a friction pad, and means for limiting inward movement of the pad to a point wherein it projects just beyond the said inner cylindrical surface of said ring member, said pad has a radial axis and an inwardly located head for contacting the shaft on which said head is mounted, the portion of said pad projecting beyond the inner cylindrical surface of said ring member being chamfered at its edges to facilitate movement past edge portions when the head is circumferentially adjusted, said ring member is formed on its interior surface with a recess, said pad being disposed within said recess, said pad having a shank portion spaced away from the walls of said pocket to provide an annular chamber, said spring means comprising a single compression spring disposed within said annular chamber, said movement-limiting means comprising a bolt having a head recessed within said pad and a shank passing through said pad and threadedly received by said ring member.

* * * * *